US009453618B2

(12) United States Patent
Loh

(10) Patent No.: US 9,453,618 B2
(45) Date of Patent: Sep. 27, 2016

(54) LED SOLUTIONS FOR LUMINARIES

(76) Inventor: Ban P. Loh, San Jose, CA (US)

( * ) Notice: Subject to any disclaimer, the term of this patent is extended or adjusted under 35 U.S.C. 154(b) by 280 days.

(21) Appl. No.: 13/456,869

(22) Filed: Apr. 26, 2012

(65) Prior Publication Data

US 2012/0212952 A1 Aug. 23, 2012

Related U.S. Application Data

(63) Continuation-in-part of application No. 13/163,437, filed on Jun. 17, 2011, and a continuation-in-part of application No. 13/019,900, filed on Feb. 2, 2011.

(60) Provisional application No. 61/480,646, filed on Apr. 29, 2011.

(51) Int. Cl.

| | |
|---|---|
| ***F21V 29/00*** | (2015.01) |
| ***F21K 99/00*** | (2016.01) |
| ***F21V 3/00*** | (2015.01) |
| ***F21V 29/71*** | (2015.01) |
| *F21Y 101/02* | (2006.01) |

(52) U.S. Cl.

CPC ..... *F21K 9/135* (2013.01); *F21K 9/137* (2013.01); *F21V 3/00* (2013.01); *F21V 29/717* (2015.01); *F21Y 2101/02* (2013.01)

(58) Field of Classification Search

CPC ..... F21K 9/13; F21K 9/135; F21K 9/137; F21V 29/74; F21V 29/2293; F21V 29/02; F21V 3/00

USPC ..... 362/294, 373, 249.02

See application file for complete search history.

(56) References Cited

U.S. PATENT DOCUMENTS

| | | | | |
|---|---|---|---|---|
| 7,476,004 | B2 * | 1/2009 | Chan | 362/240 |
| 7,815,338 | B2 * | 10/2010 | Siemiet et al. | 362/218 |
| 7,950,821 | B1 * | 5/2011 | Georgitsis et al. | 362/217.12 |
| 8,267,549 | B2 * | 9/2012 | Hwang et al. | 362/294 |
| 8,313,220 | B2 * | 11/2012 | Chang | 362/373 |
| 8,534,872 | B2 * | 9/2013 | Liu et al. | 362/294 |
| 8,537,554 | B1 * | 9/2013 | Hockaday | 361/713 |
| 2007/0063321 | A1 | 3/2007 | Han | |
| 2007/0200133 | A1 | 8/2007 | Hashimoto | |
| 2007/0243645 | A1 | 10/2007 | Lin | |
| 2008/0037239 | A1 * | 2/2008 | Thomas et al. | 362/92 |
| 2008/0283234 | A1 * | 11/2008 | Sagi et al. | 165/182 |
| 2009/0040766 | A1 | 2/2009 | Pabst | |
| 2009/0086492 | A1 | 4/2009 | Meyer | |
| 2009/0284973 | A1 | 11/2009 | Liao | |

FOREIGN PATENT DOCUMENTS

KR 1020090003378 A 1/2009

* cited by examiner

*Primary Examiner* — Peggy Neils

(57) ABSTRACT

A LED lighting device is disclosed. The LED lighting device includes one or more of the following components, in any combination: structural body with heat-fins, LED light module, LED driver circuit board, electrical screw-cap, thermal end-cap, heat transport device, heat-sink and heat-foil. This invention presents a substantial cost saving in the LED adaptation to retrofit the existing light fixtures and luminaires. Its other advantages include, without limitation, having standard electrical connector to achieve ease of use and interchangeability, reduced light loss by having its own integrated build-in reflector with more effective optical design, an increase in energy saving through thermal solutions to lower LED's operating junction temperature for better performance and increased reliability.

14 Claims, 16 Drawing Sheets

LED SOLUTIONS FOR LUMINARIES

CROSS-REFERENCE TO RELATED APPLICATIONS

This patent application claims the benefit of and priority under 35 USC sections 119 and 120 to U.S. Provisional Patent Application Ser. No. 61/480,646 filed Apr. 29, 2011. The Application 61/480,646 is incorporated herein by reference in its entirety. Further, this patent application claims the benefit of and priority to U.S. patent application Ser. No. 13/163,437 filed on Jun. 17, 2011. This patent application, being a continuation-in-part of application Ser. No. 13/163,437, incorporates by reference application Ser. No. 13/163,437 in its entirety. Further, this patent application claims the benefit of and priority to U.S. patent application Ser. No. 13/019,900 filed on Feb. 2, 2011. This patent application, being a continuation-in-part of application Ser. No. 13/019,900, incorporates by reference application Ser. No. 13/019,900 in its entirety.

BACKGROUND

The present invention relates to light emitting devices. More particularly, the present invention relates to light emitting device modules and lighting devices.

Incandescent light bulb emits visible light when electrical current passes through its resistor wire (typically tungsten) to heat it up till it glows and radiates light. A typical incandescent light bulb emits 22 Lumens of light per watt of energy absorbed by the resistor wire. The resistor wire is eventually burned off after an average of 750 hours. Incandescent light typically produces a spectrum of Red, Green and Blue lights. CRI (Color Rendering Index) is used to describe spectrum of color, 1 being perfect while zero being the worst. Incandescent light has a CRI better than 0.9 while fluorescent is around 0.5-0.7 meaning an object's actual color was 50%-70% illuminated by the light, e.g. a red object may appear to be burgundy rather than its actual red color. HID (High Intensity Discharge) sodium light is amber light that has a very low CRI; as such most colors under its illumination appear to be of different colors.

Fluorescent light is produced by passing electricity to excite mercury vapor inside a vacuum tube to produce UV (Ultraviolet) radiation which in turn causes a phosphor powder coated on the walls of the tube to fluoresce, producing visible light. Fluorescent light bulb produces more light output and last much longer than Incandescent light bulb. But, its disadvantages are low CRI meaning and it contains hazardous chemicals such as mercury which is known to retard brain development in young people or to cause certain cancers. Disposal of Fluorescent light bulb has become an environmental problem in the world today as its hazardous chemicals post serious health threat if the hazardous chemical is air borne and inhaled by human.

HID (High Intensity Discharge) light, also referred to as Arc Lamp, uses electricity to produce electric arc between its tungsten electrodes housed inside a translucent quartz tube that is filled with both gas and metal salts. The arc evaporates the metal salts to form plasma which greatly increase the intensity of light produced by the arc. HID produces more visible light than incandescent and fluorescent lights. However, its disadvantages are similar to fluorescent light as it yields very low CRI and contains hazardous chemicals such as sodium or mercury. Examples are High or Medium Pressure Sodium Light which produce only amber color light that are commonly used to illuminate streets or highways.

Light emitting diode (LED) light bulbs are superior to all of the light bulbs produced by the above light sources. With very fast advance in LED semiconductor chip technology, an LED chip can produce more than 125 Lumens per watt of neutral white light with 80 percent CRI and 100 lumens of warm white light with 90 percent CRI.

Also, LED has a much longer life span than all the other light sources. LED light retains 70 percent of its initial brightness after 50,000 hours of operation under normal conditions. When lighted for 24 hours a day with the usual electrical current, its life span is 10 years.

Approximately twenty percent of the total energy used worldwide is for lighting; and the lights used are incandescent, fluorescent and HID but very few LED at this present moment. As LED light can save at least fifty percent energy used for lighting, it is important to save the world's energy consumption by changing all lights to LED. Potentially, LED can save at least ten percent of the world total energy usage and this is millions of barrels of petroleum or tens of nuclear plants that need to be built in the next few years.

However, because of complexity and difficulties encountered in the design and thermal solution needs to retrofit of LED light source replacing the other light source, adaptation of LED light has been extremely slow. Further, many LED street lights, for example, failed within a year—due to poor thermal design in the fixture—hence scaring off many potential users.

Accordingly, there remains a need for an LED lighting device that can retrofit the existing fixtures and luminaires, to deliver its expected performance and life expectancy, with a much lower initial cost.

SUMMARY

The need is met by the present invention. In the first embodiment of the present invention, a lighting device includes a body, a platform where at least one LED module is mounted, and heat fins on the body. The body defines side opening through which the light from the LED module exits. A lens covers the side opening. A reflector is placed proximal to the side opening to reflect light from the LED module in a desired direction. The body has a tubular shape and defines a first and a second end. A thermal end cap covers the first end of the body. An Edison screw cap covers the second end of the body. A sleeve is coupled to the second end of the body. A screw adaptor is fitted or rotatably engaged to the sleeve and can turn relative to it. The screw adaptor defines a groove track. A dowel pin engages the sleeve and riding along the groove track when turning. A set screw engages the sleeve providing a locking mechanism.

The lighting device has a tubular shape having a first end and a second end. The first end is covered by an end cap and the second end is terminated or covered by an Edison screw cap. At least one heat foil may be is connected to the body, the heat foil providing additional heat dissipation surface. The heat foil is coupled to the body along a groove defined by the heat fins of the body. A retaining bar may be inserted along the groove to press the heat foil against to the body, thus conducting heat out from the body. One or more circuit boards may be provided within the lighting device for mounting electrical components.

In a second embodiment of the present invention, a lighting device includes a light bulb and an external heat sink. The side emitting light bulb includes a body defining a side opening and having an external surface. At least one LED module is placed within the body. The LED module can be powered up by electrical current to emit light and heat is generated as a result. An external heat sink is connected to the light bulb, the external heat sink having a plurality of heat fins. A heat pipe is connected to the body of the light bulb. A heat adaptor is connected to the heat pipe. And a heat bolt is connected to the heat adaptor and the external heat sink. The heat pipe includes a close-end tube which contains cooling fluids that can transport heat from a hot end to a cold end at a much faster than pure copper, for example. The light bulb has a platform where the LED module is mounted. The platform is bonded to said body for heat dissipation. The body includes heat fins on its external surface, the heat fins increasing the surface area of the body for increased heat dissipation.

In a third embodiment of the present invention, luminaire includes a light bulb, a housing enclosing the light bulb, an external heat sink thermally connected to the light bulb, and a heat pipe connecting the light bulb with the external heat sink. A heat adaptor connects the heat pipe. A heat bolt connects to the heat adaptor and the external heat sink. The housing defines an opening through which the heat bolt passes to connect the heat adaptor, enclosed within the housing, to the external heat sink, external to the housing. A sleeve is coupled to the body. A screw adaptor is rotatably engaged to the sleeve. The screw adaptor defines a groove track. A dowel pin engages the sleeve and riding along the groove track. A set screw engages the sleeve providing a locking mechanism. The housing includes an Edison socket adapted to engage the Edison screw threads.

In a forth embodiment of the present invention, a luminaire includes a light bulb, a housing enclosing the light bulb, and at least one heat foil couple to the light bulb. The heat foil extends beyond the housing allowing heat from the light bulb to dissipate outside the housing. The light bulb includes a body having heat fins, the heat fins forming grooves where the heat foil couples with the light bulb.

DETAILED DESCRIPTIONS

The present invention is described with reference to the FIG. 1A though 9D which illustrate the various embodiments. As illustrated in the figures, some sizes of structures or portions are exaggerated relative to other structures or portions for illustrative purposes and thus, are provided to aid in the illustration and the disclosure of the present invention.

Each of the incorporated documents (including provisional applications and non-provisional applications) includes drawings and specifications having figure designations, reference numbers, and their descriptions. To preserve consistency, some (but not all) figure designations, reference numbers, or both (of one or more of the incorporated documents) are used in the present document for portions or structures of various embodiments that corresponds to identical or similar portions or structures of embodiments disclosed by the incorporated documents. However, in general, to avoid confusion and to describe the inventions with even more clarity, in this document, figure designations, reference numbers, and their descriptions are independent from and of the incorporated documents. To avoid duplication and clutter, and to increase clarity, in the Figures, not every referenced portion is annotated with its reference number in every Figure.

Figure 7C:
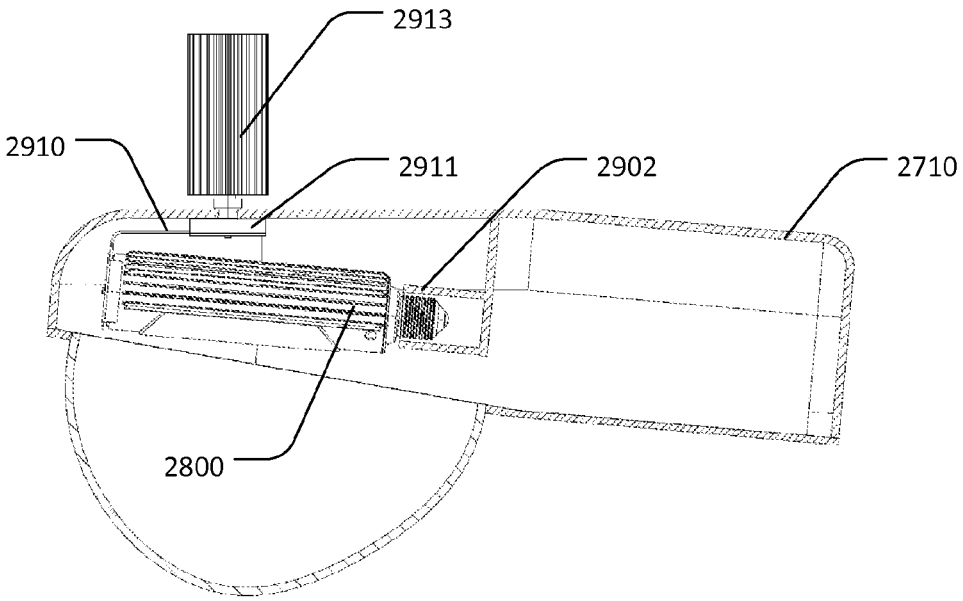
FIG. 7C is a cut-away side view of the third embodiment of the present invention illustrated in FIG. 7A cut along line A-A illustrated in FIG. 7B.
Figure 7D:
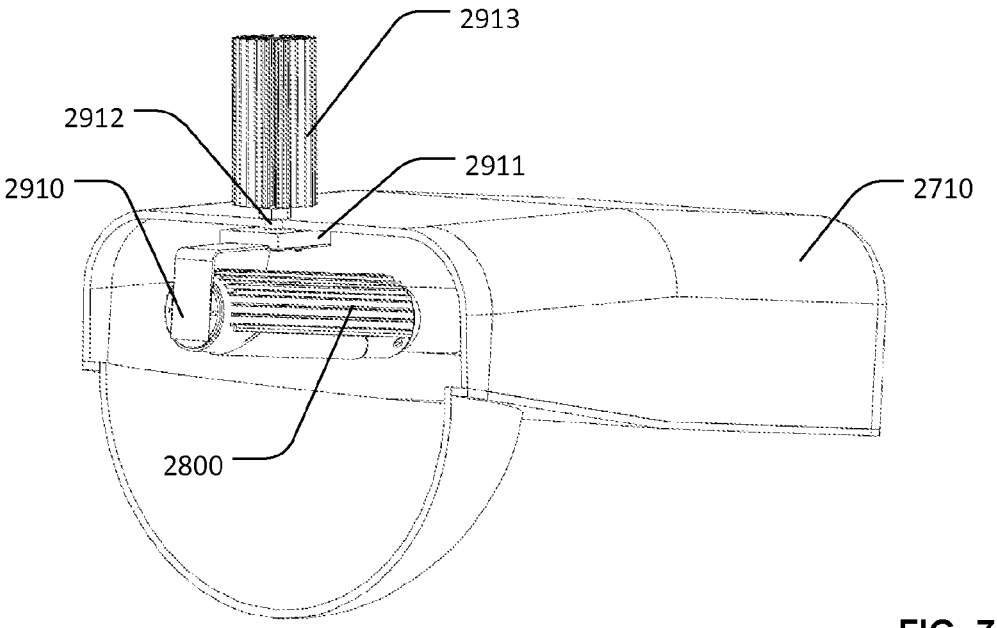
FIG. 7D is a cut-away front perspective view of the third embodiment illustrated in FIG. 7A with some parts of external portions removed for illustration.
Figure 8A:
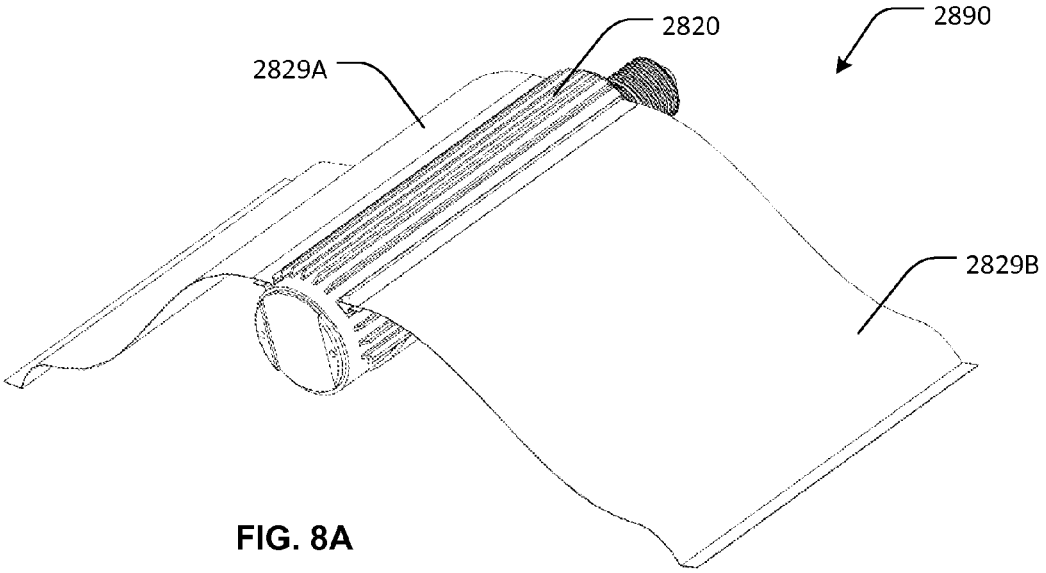
FIG. 8A is a partial exploded perspective view of a fourth embodiment of the present invention.
Figure 8B:
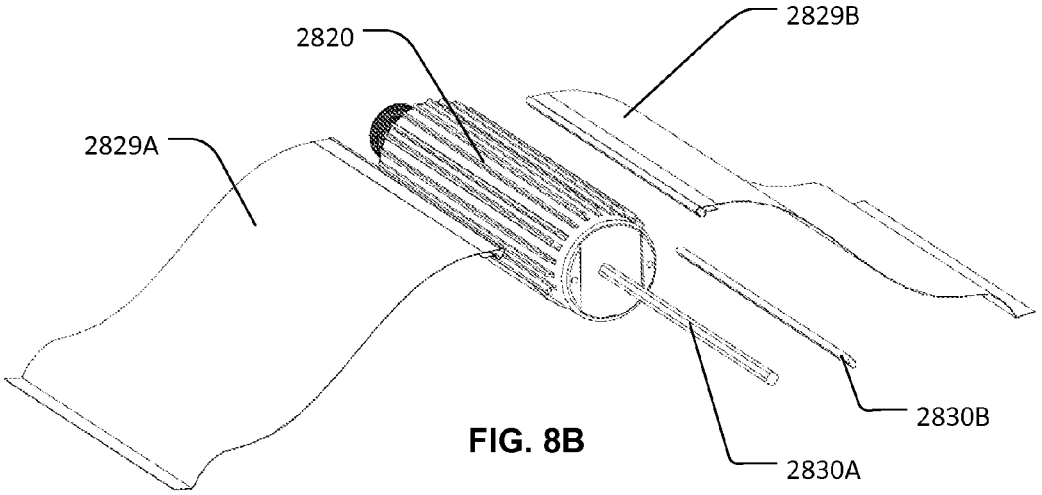
FIG. 8B is a partially exploded perspective view of the fourth embodiment of the present invention illustrated in FIG. 8A.
Figure 8C:
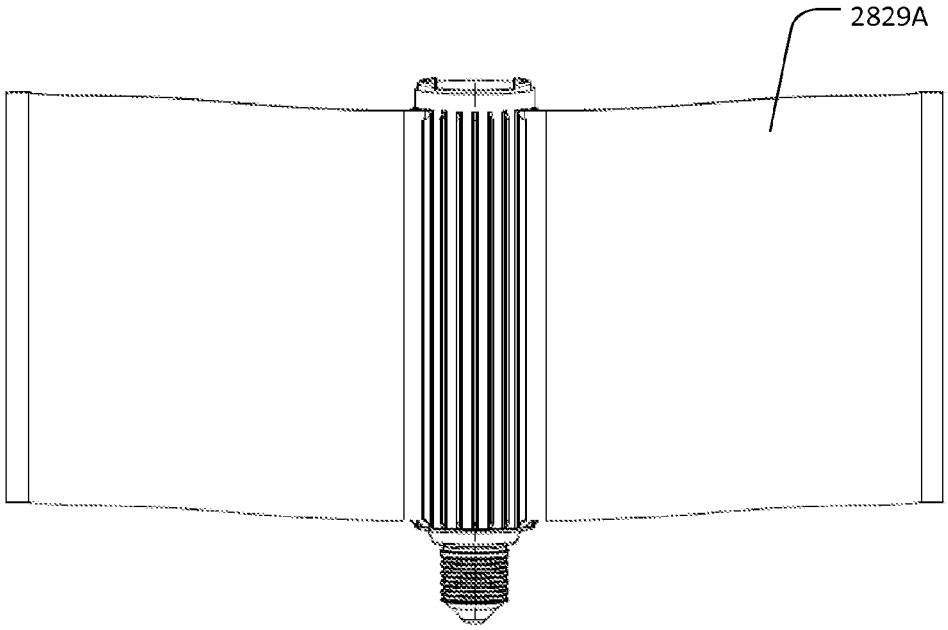
FIG. 8C is a top view of the fourth embodiment of the present invention illustrated in FIG. 8A.
Figure 8D:
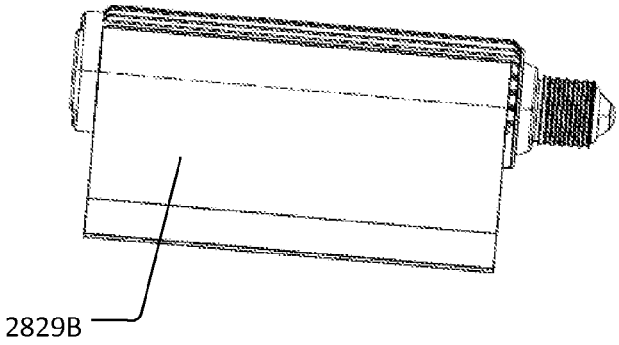
FIG. 8D is a side view of the fourth embodiment of the present invention illustrated in FIG. 8A.
Figure 9A:
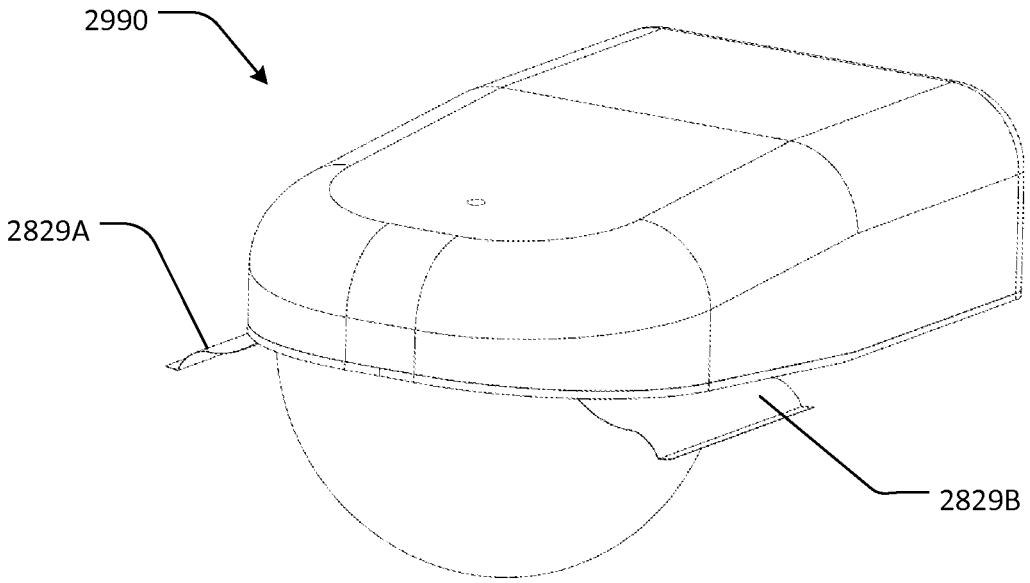
FIG. 9A is a perspective view of a fifth embodiment of the present invention.
Figure 9B:
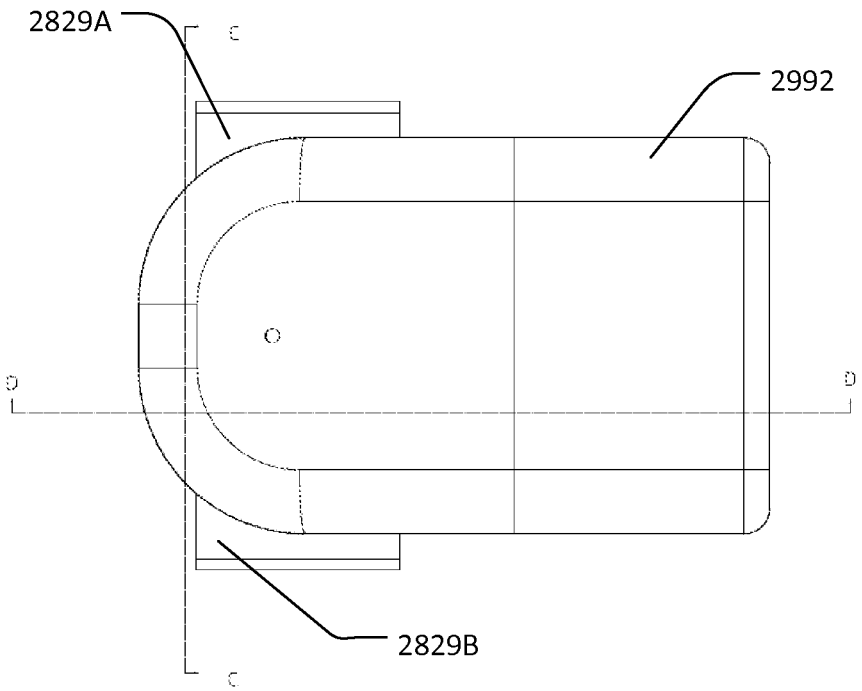
FIG. 9B is a top view of the fifth embodiment of the present invention illustrated in FIG. 9A.
Figure 9C:
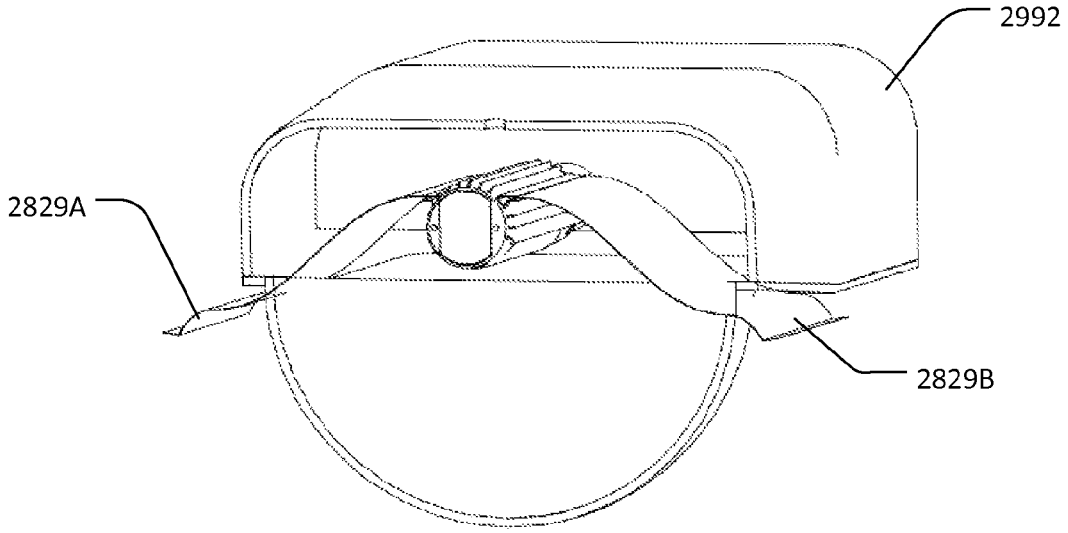
FIG. 9C is a front partially cut-away perspective view of the fifth embodiment of the present invention illustrated in FIG. 9A cut along line C-C illustrated in FIG. 9B.
Figure 9D:
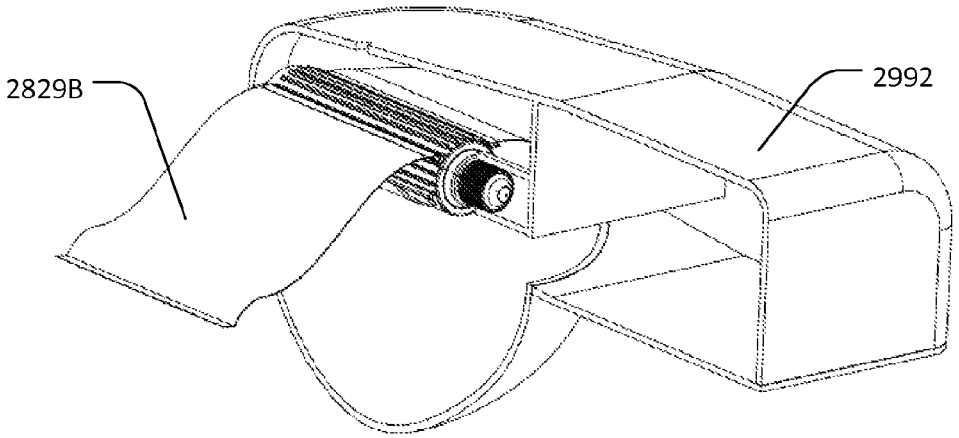
FIG. 9D is a rear partially cut-away perspective view of the fifth embodiment of the present invention illustrated in FIG. 9A cut along line D-D illustrated in FIG. 9B.

The invention is disclosed in the following example embodiments: a first embodiment of a side emitting light bulb (SELB) illustrated in FIGS. 1A through 4B, and discussed below; a second embodiment is SELB with an extended heat sink assembly illustrated in FIGS. 5A through 6B and discussed below; a third embodiment is SELB with second embodiment assembled into a Luminaire illustrated in FIGS. 7C through 7D; and a fourth embodiment is SELB with added thermal foils illustrated in FIGS. 8A through 8D; and a fifth embodiment is SELB with the forth embodiment assembled into a Luminaire as illustrated in FIGS. 9C through 9D.

First Embodiment of the Present Invention

Figure 1A:
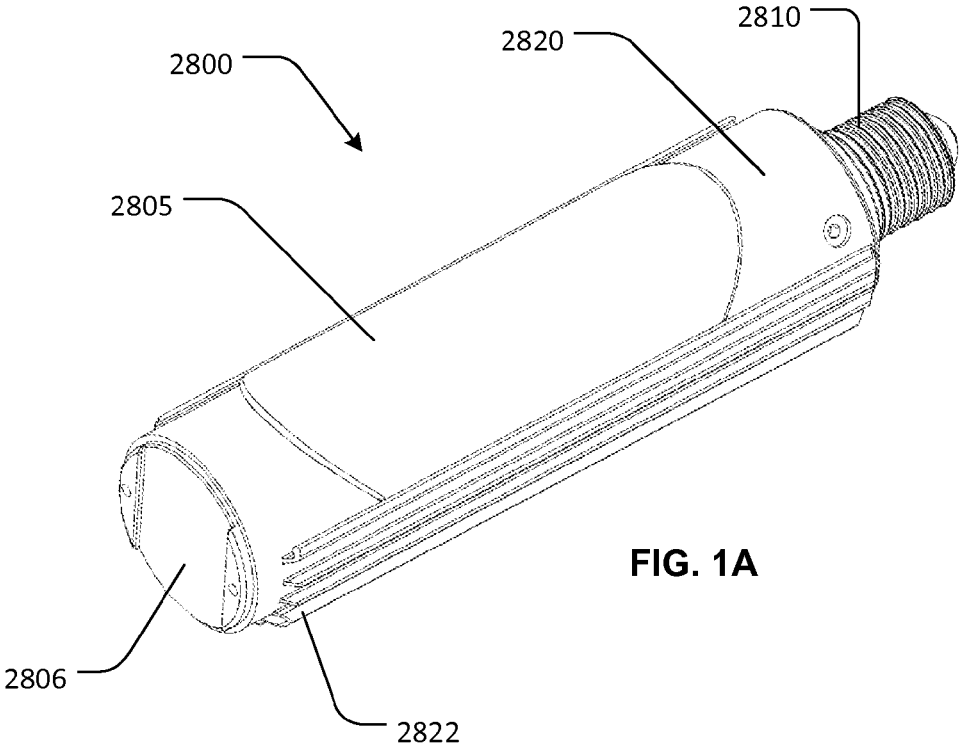
FIG. 1A is a perspective view of a first embodiment of the present invention.
Figure 1B:
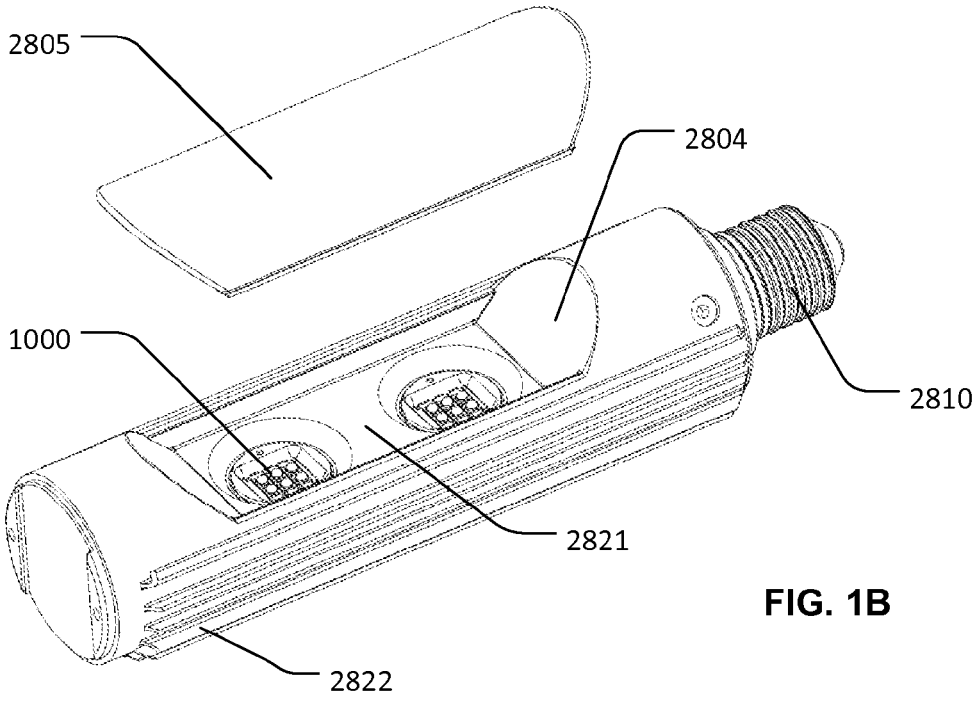
FIG. 1B is a partially exploded perspective view of the first embodiment of the present invention of FIG. 1A.
Figure 2A:
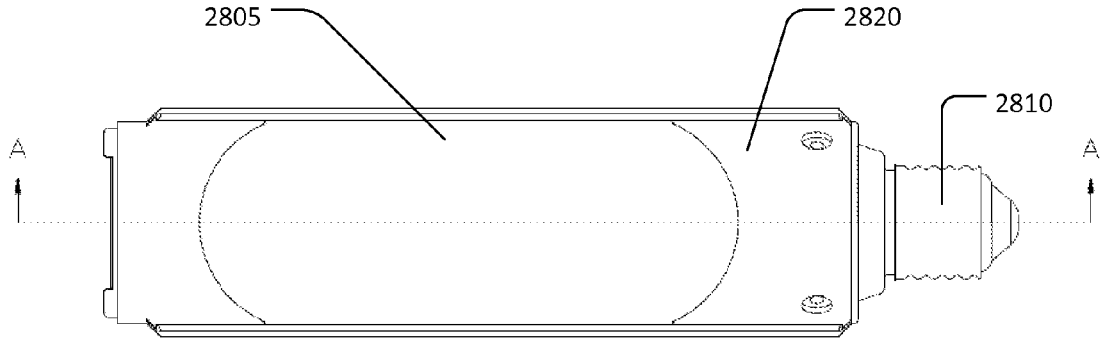
FIG. 2A is a top view of the first embodiment of the present invention of FIG. 1A.
Figure 2B:
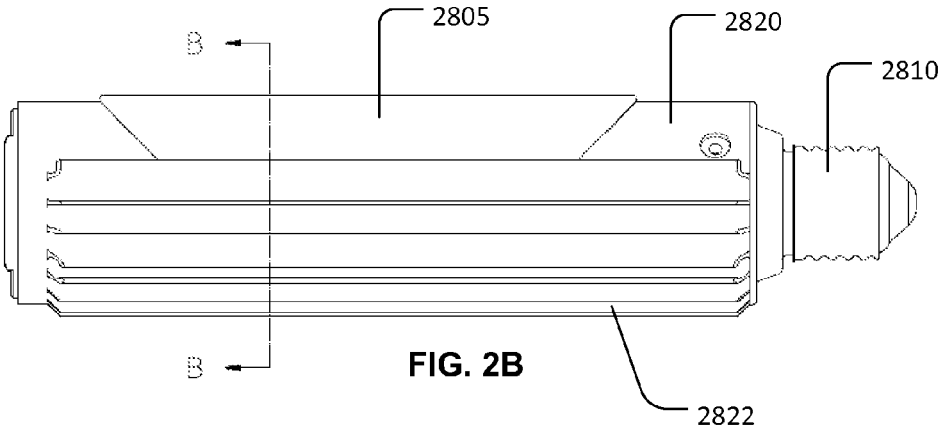
FIG. 2B is a side view of the first embodiment of the present invention of FIG. 1A.
Figure 2C:
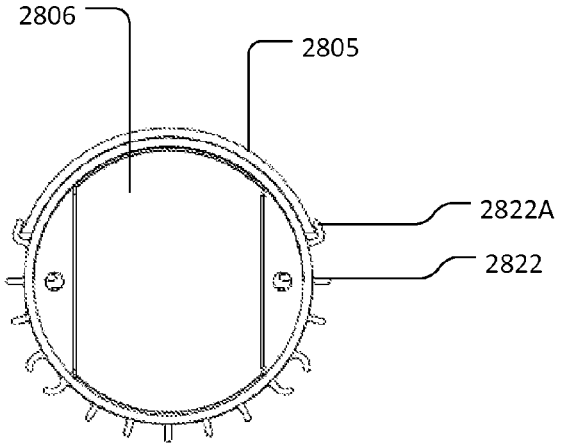
FIG. 2C is a first end view of the first embodiment of the present invention of FIG. 1A.
Figure 2E:
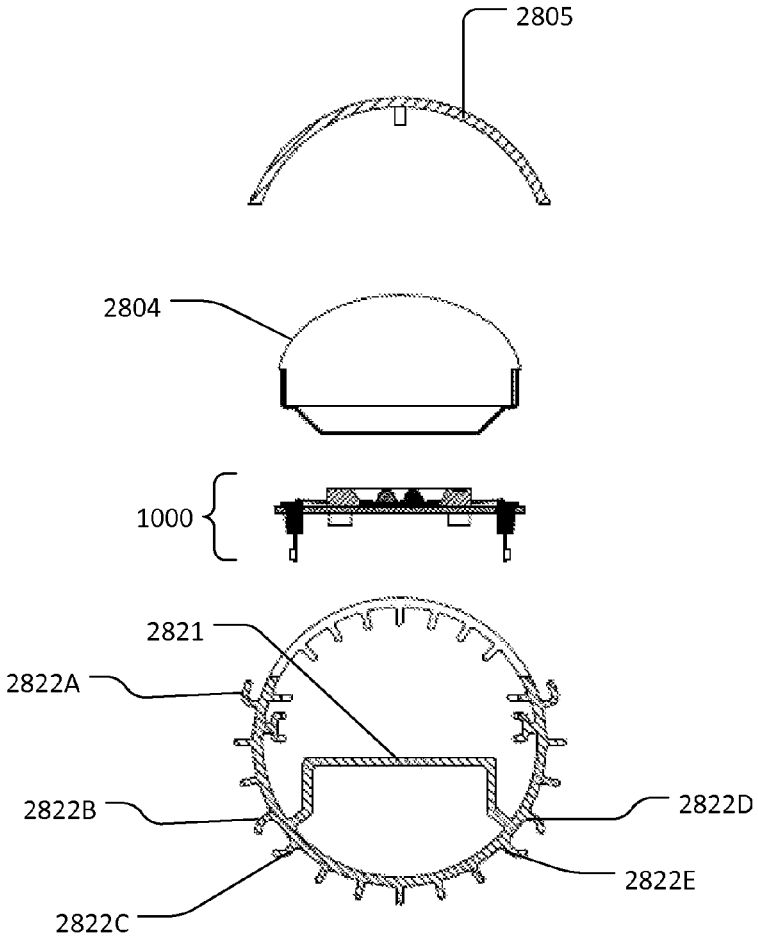
FIG. 2E is an exploded end view of the first embodiment of the present invention of FIG. 1A cut across line B-B illustrated in FIG. 2B.
Figure 2D:
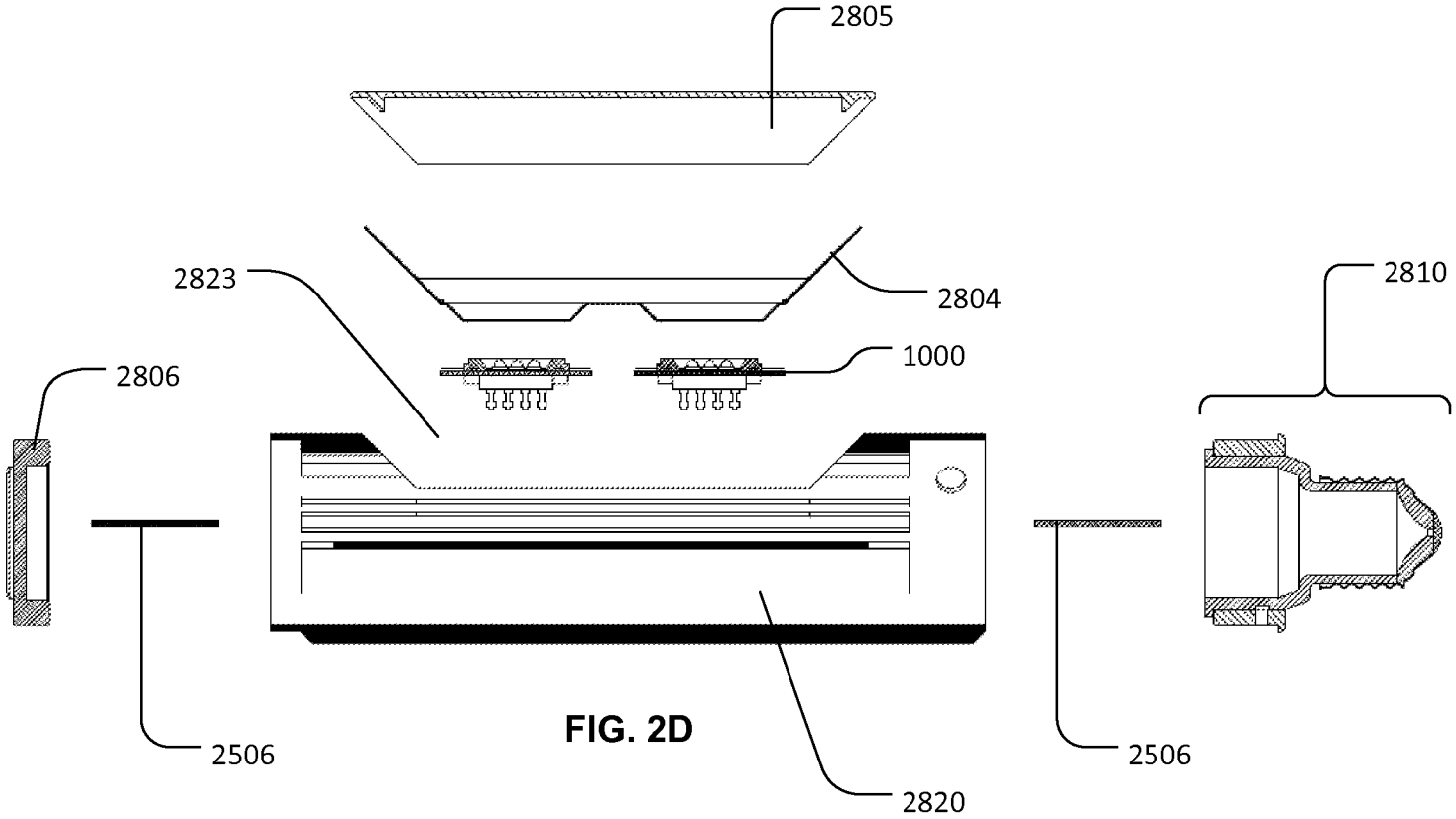
FIG. 2D is an exploded side view of the first embodiment of the present invention of FIG. 1A cut across line A-A illustrated in FIG. 2A.
Figure 3:
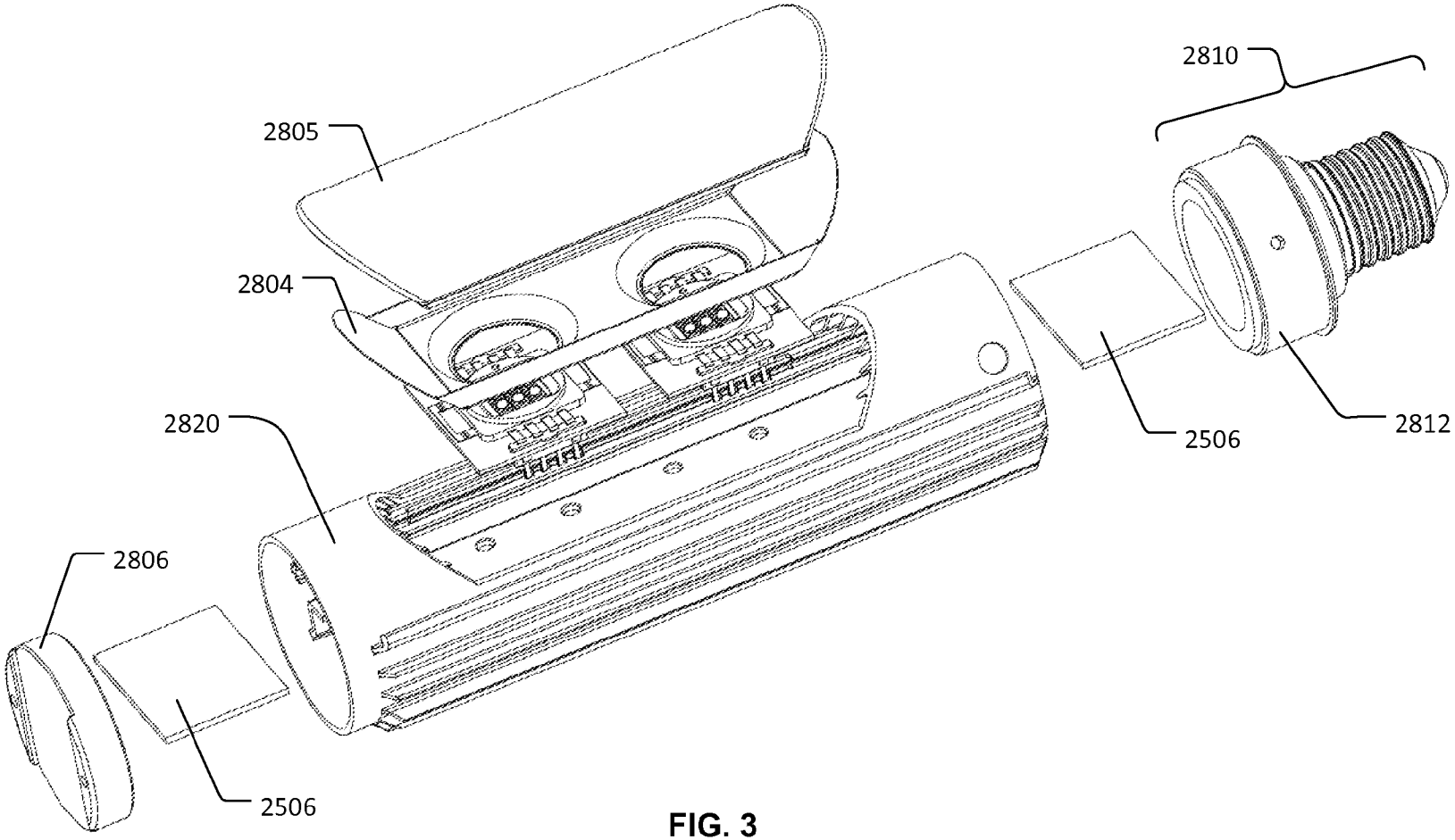
FIG. 3 is an exploded perspective view of the first embodiment of the present invention of FIG. 1A.
Figure 4A:
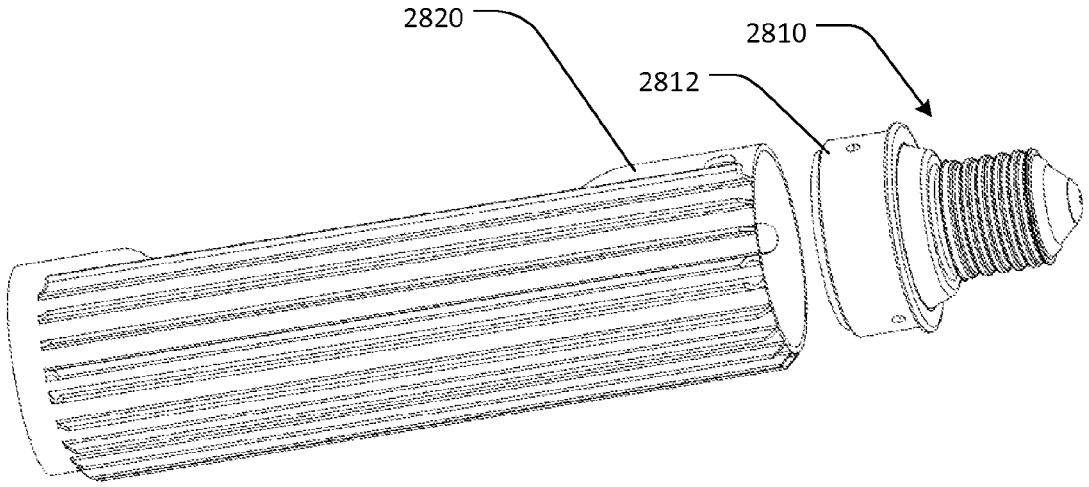
FIG. 4A is a partially exploded perspective view of the first embodiment of the present invention of FIG. 1A.
Figure 4B:
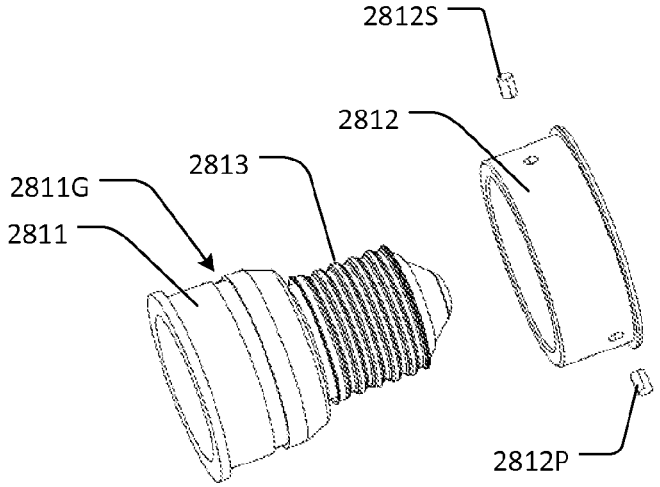
FIG. 4B is a partially exploded perspective view of a portion of the first embodiment of the present invention of FIG. 1A.

FIG. 1A is a perspective view of a first embodiment of the present invention illustrated as a side emitting light bulb 2800 (SELB), also referred to as a light emitting diode (LED) Device 2800. FIG. 1B is a partially exploded perspective view of the SELB 2800. FIG. 2A is a top view of the SELB 2800. FIG. 2B is a side view of the SELB 2800. FIG. 2C is a first end view of the SELB 2800. FIG. 2D is an exploded side view of the SELB 2800 cut across line A-A illustrated in FIG. 2A. FIG. 2E is an exploded end view of the SELB 2800 cut across line B-B illustrated in FIG. 2B. FIG. 3 is another exploded perspective view of the SELB 2800. FIG. 4A is a partially exploded perspective view of the SELB 2800. FIG. 4B is a partially exploded perspective view of a portion of the SELB 2800.

Body 2820 (FIG. 1A, 1B, 1C, 2A, 2B, 2D)

Referring to FIGS. 1A to 4B, the SELB 2800 includes the Body 2820, preferably made of thermally conductive material such as, Aluminum or Copper to extract heat generated by an LED Module 1000 inside. In the illustrated embodiment, the Body 2820 is substantially cylindrical tube in shape having substantially hollow interior and defining multiple openings; however, in other embodiments, the Body 2820 may have other shapes. The present invention is not limited to a cylindrically shaped Body 2820. When the LED module 1000 operates to generate light, much heat is generated by the LED module 1000 and this should be dissipated or LED may fail due to overheating.

The Body 2820 is equipped with a plurality of external Heat-fin 2822 on its external surface; the Heat-fin 2822 draws heat from Body 2820. The Heat-fin 2822 provides a greater external surface area and can dissipate heat efficiently to its surrounding air by convection. Also, heat from the Heat-fin 2822 and the Body 2820 can be drained away by any thermally conductive material or device which makes good contact with either or both of these. The Heat-fins 2822 are made of thermally conductive material. The Heat-fins 2822 can be made to any shape to serve other purposes such as, for example, engaging with other components, for example, a lens, an external heat-sink, etc. Reference number 2822 indicates heat fins in general. Particular heat fins with additional functions are indicated with reference number 2822 followed by a letter such as, for example, 2822A, 2822B, or 2822C. The Heat-fin 2822 and the Body 2820 can be easily made by Aluminum extrusion.

Body 2820 may be machined to a suitable length and to define a side opening 2823 on its side to allow light emitted by the LED modules 1000 to exit the Body 2820. The opening 2823 of the Body 2820 may be covered with a lens 2805, also referred to as a lens cover 2805.

In the illustrated sample embodiment, the lens 2805 is made of a transparent plastic or glass and is so shaped to cover the opening 2823 of the Body 2820. The lens 2805 may be clear, colored, diffused, or textured to scatter lights. The lens 2805 may be secured to the Body 2820 by means of an adhesive or by some mechanical fixture. The lens 2805 is engaged to the Body 2820 by a mounting hook 2822A, the mounting hook 2822A being a special hook feature. The mounting hook 2822A also provides protection for edges of the lens 2805. This is most clearly illustrated in FIGS. 2C and 2E. The mounting hook 2822A may be, as illustrated, a specifically designated heat fin having the desired shape to engage the lens 2805. In addition, the mounting hook 2822A may be used for other purposes such as, to engage the Body 2820 to other components or systems such as, for example, heat foil which can further transport heat energy generated by LED away from SELB 2800 to other places such as a luminaire.

In the illustrated sample embodiment, the Body 2820 having a tubular shape defines a hollow interior within which various structures may be provided. For example, a platform 2821 is placed inside the Body 2820 for mounting one or more LED modules 1000. The platform 2821 is either an integral part or, if a separate item, can couple to the Body 2820 by soldering or thermal adhesive. Light from the LED modules exits the SELB 2800 through the opening 2823. For example, two LED modules 1000 are illustrated in the drawings. However, in the present invention any number of LED modules may be mounted within the Body 2820.

Reflector 2804 (FIG. 1B, 2D, 3)

The SELB 2800 also includes a Reflector 2804 positioned proximal to or within the opening 2823 to reflect light from the LED modules 100 toward a desired direction. The reflector 2804 may be made by stamping or forming on any thin reflective sheet of metal or plastics, for example only, Alanod or Lorin which has more than 86 percent reflectance. The reflector 2804 may also be molded with plastic, followed by coating with reflective materials such as metal Aluminum or Silver. In addition, the Reflector 2804 may be made by a plastic material, for example, Amodel (trade name of a high temperature engineering plastics which is filled with highly reflective power such as Titanium Dioxide.

Thermal End-Cap 2806 (FIG. A, 2C, 2D)

A thermal end-cap 2806 covers a first end of the tubular shaped the Body 2820. The end-cap 2806 also may be used to mount or connect SELB 2800 to other components as illustrated in FIGS. 5A through 9D and discussed herein below. The end-cap 2806 also may be bonded by thermal adhesive to a thermal transport device, for example a heat pipe which functions as a thermal transport device to conduct heat away from the Body 2820. The end-cap 2806 may include screw threads that would allow screws be used for mechanical connections to the other components.

Rotating Edison Screw Cap 2810 (FIG. 4B)

The second end of the Body 2820 is fitted with an Edison screw-cap 2810, for example, E27, E39 or other types, to enable the SELB 2800 to be screwed onto an Edison electrical socket which supplies electrical power. The Edison screw cap 2810 can bottom out in the Edison electrical socket having the SELB 2800 facing a direction that may not be desired. Therefore, the SELB 2800 can be rotated about its axis such that the Lens 2805 to face any direction as desired. Because of this flexibility, the SELB 2800 can be screwed into any socket while the light emitting from it can be adjusted to face any direction. The Edison screw cap 2810 defines the screw threads 2813.

To provide for rotational adjustability, the screw cap 2810 includes a screw adaptor 2811 defining a groove track 2811G. A sleeve 2812, attached to the Body 2820, rotationally engages the screw adaptor 2811. A Dowel pin 2812P rides inside the groove 2811G to limit the relative rotation between the sleeve 2812 and the screw adaptor 2811 to a rotational angle, for example 350 degrees, that is less than a full turn (360 degrees); without the rotational limit, internal wires (not shown) connecting the Edison cap 2810 to the LED modules 100 may be tangled.

The relative rotational position of the Body 2820 with respect to the screw cap 2810 is locked by one or more set screws 2812S. A maximum adjustable angle in the rotating mechanism may be limited to less than a full turn (360 degrees), for example, 350 degrees.

The SELB 2800 may also house components such as, for example only, electrical printed circuit boards 2506. Often, the circuit boards 2506 include driver circuits for regulating the input electrical to a suitable electrical power that power the LED modules 1000.

Second Embodiment of the Present Invention (FIG. 5A to 6C)

Figure 5A:
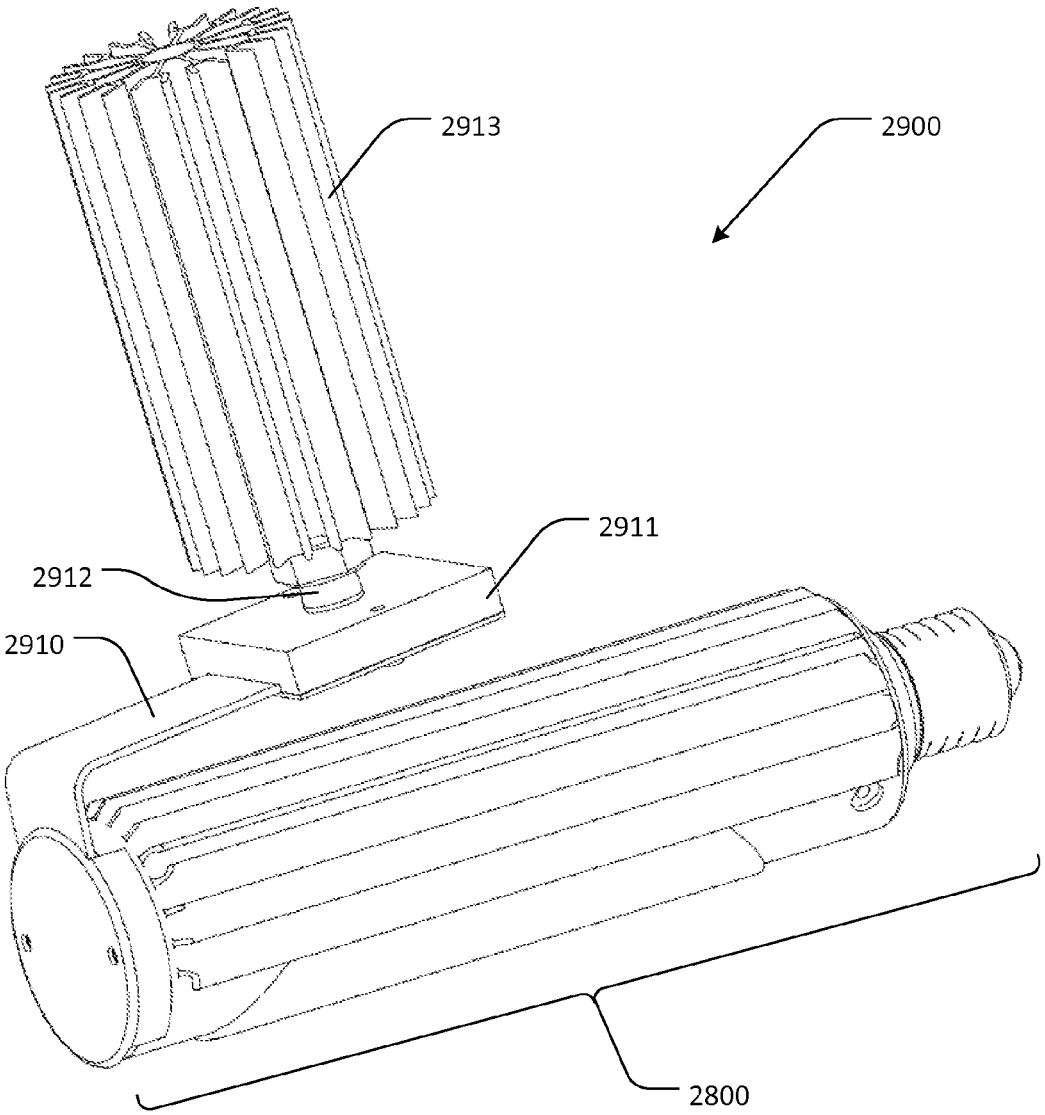
FIG. 5A is a perspective view of a second embodiment of the present invention.
Figure 5B:
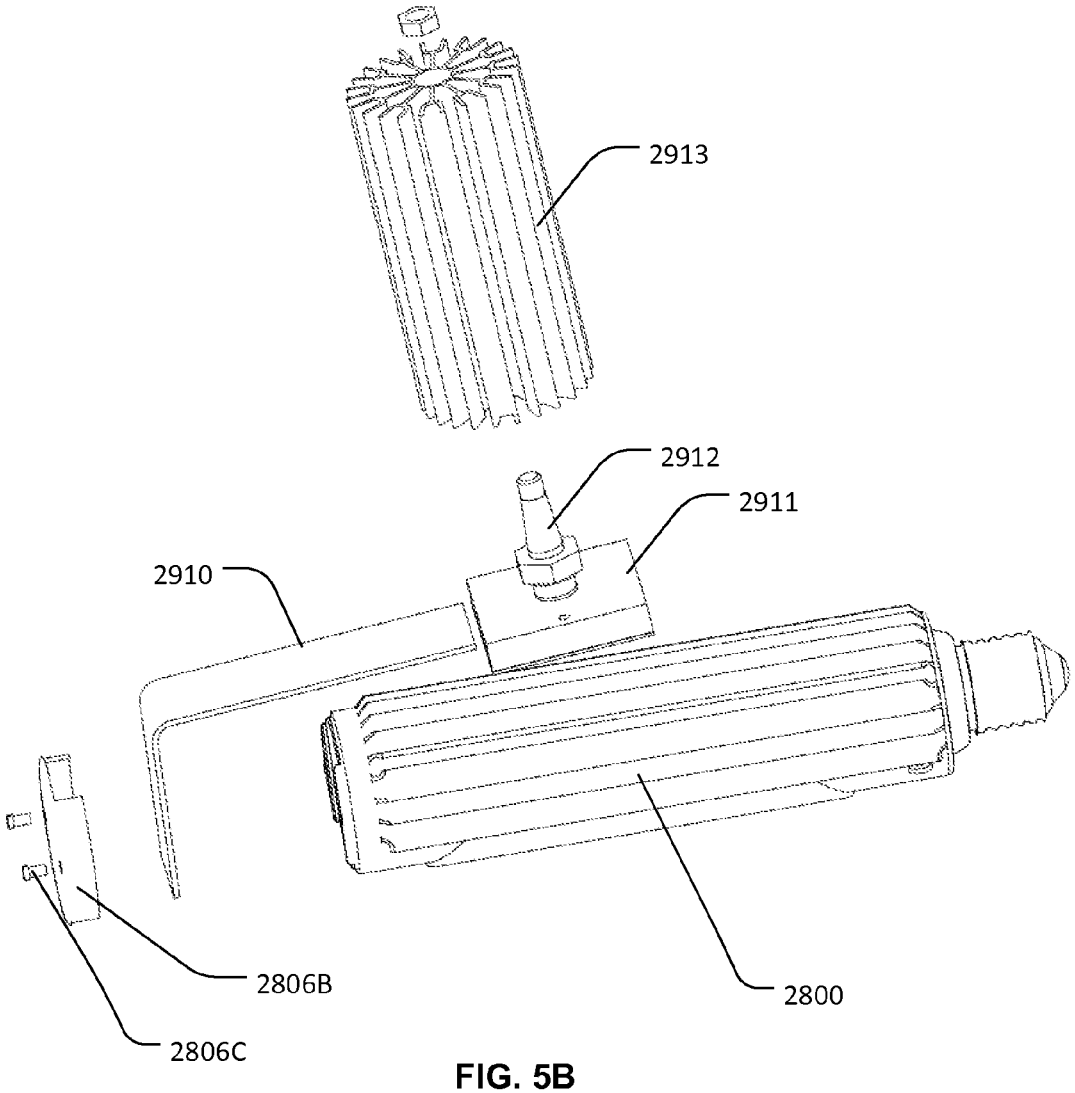
FIG. 5B is a partially exploded perspective view of the second embodiment of the present invention illustrated in FIG. 5A.
Figure 6A:
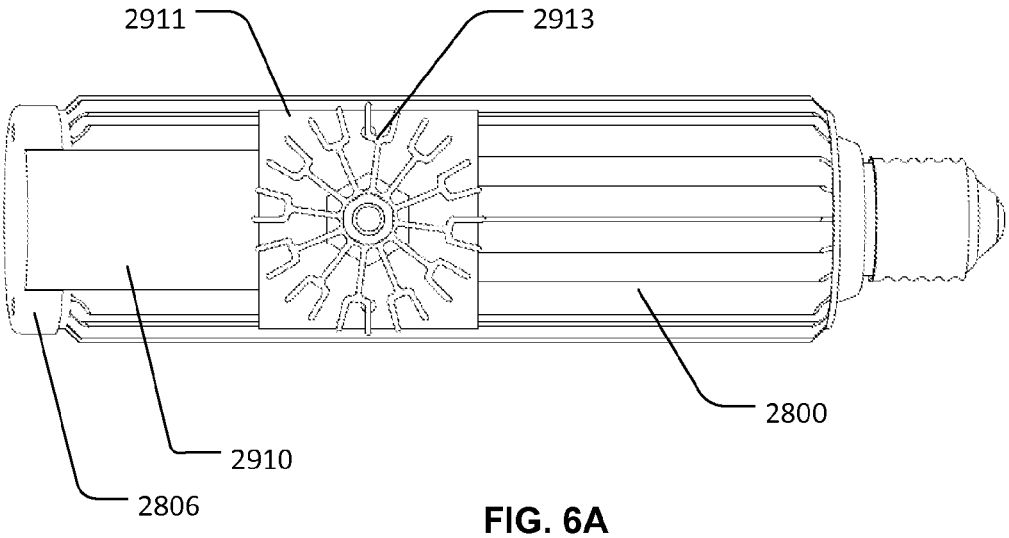
FIG. 6A is a top view of the second embodiment of the present invention illustrated in FIG. 5A.
Figure 6C:
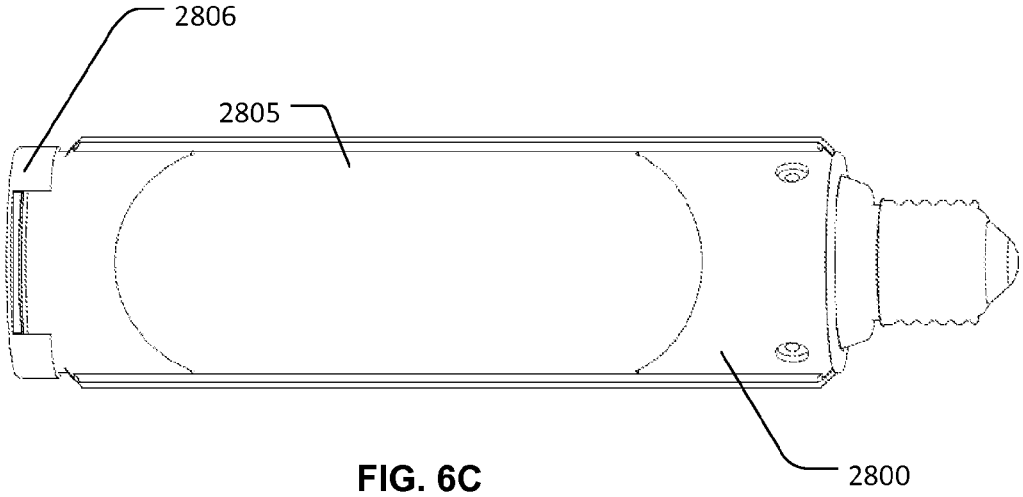
FIG. 6C is a bottom view of the second embodiment of the present invention illustrated in FIG. 5A.
Figure 6B:
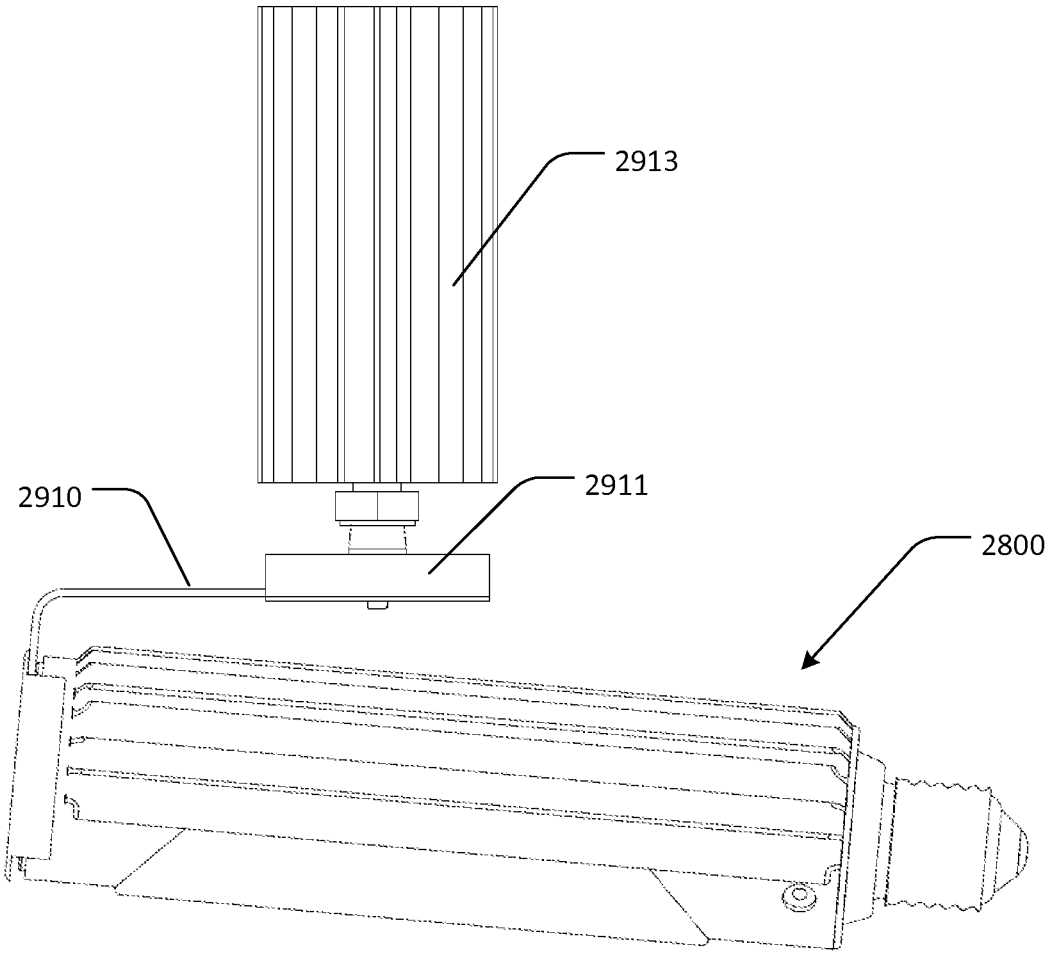
FIG. 6B is a side view of the second embodiment of the present invention illustrated in FIG. 5A.

FIG. 5A is a perspective view of a second embodiment of the present invention illustrated as lighting device 2900. FIG. 5B is a partially exploded perspective view of the lighting device 2900. FIG. 6A is a top view of the lighting device 2900. FIG. 6B is a side view of the lighting device 2900. FIG. 6C is a bottom view of the lighting device 2900.

Heat Sink 2913

Referring to FIGS. 5A through 6C, the lighting device 2900 includes the SELB 2800 (as a lighting unit) connected to an external heat sink 2913. The external heat sink 2913 can be made of thermally conductive material and have any shape depending on the desired application. In the illustrated sample embodiment, the external heat sink 2913 is made of extruded aluminum and has a cylindrical shape with a multiple fins designed to dissipate heat, Heat-Pipe 2910

A thermal transport device connects the SELB 2800 at one end to the Heat-sink 2913 at the opposite end. The Heat-pipe 2910 can be made of closed end or hollow copper or aluminum tube filled with fluids such as water, alcohol which are then vacuum sealed inside. Because of vacuum, fluids can evaporate at very low temperature quickly thus absorbing heat from the SELB 2800 and then condensate at the cool end at the Heat-sink 2913. A heat adaptor 2911 and a bolt 2912 (heat conductor bolt) are designed to fasten the Heat-pipe 2910 thermally to the heat sink 2913. Meanwhile, the opposite end of the Heat-pipe 2910 can be thermally fastened to the End-cap 2806 of SELB 2800 by means of cap cover 2806B (a flange) and screws 2806C. Alternately, thermal adhesive can in place screws. By this arrangement, heat generated by the LED module 1000 inside the SELB 2800 flows effectively to the Heat-sink 2913 which dissipates it efficiently.

Heat-Adaptor 2911

The Heat-adaptor which connects Heat-pipe 2910 to the external Heat-sink 2913 can also be thermally fastened to the Body of a lighting fixture to allow heat to transfer to the fixture which can aid in dissipate heat also.

Most existing luminaires designed for Incandescent, Fluorescent or HPS lights normally trap heat inside because all the standard light sources, for example, Incandescent, HID, etc., perform relatively well under hot environment. Whereas when LED light source is installed in these fixtures, heat should be removed from inside the fixture otherwise, the LED will fail due to of heat. Hence, the second embodiment is specially designed to remove the heat from inside of a luminaire.

Third Embodiment of the Present Invention

Figure 7A:
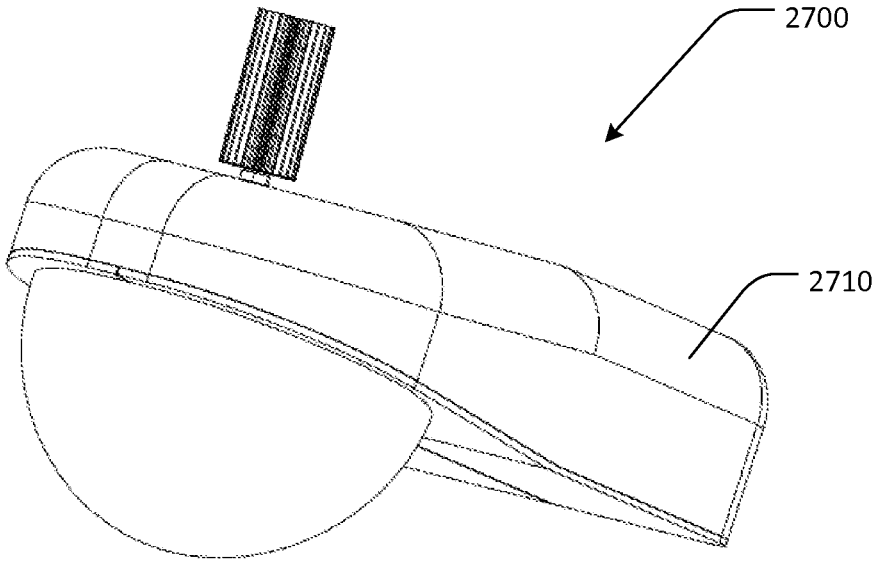
FIG. 7A is a side perspective view of a third embodiment of the present invention.
Figure 7B:
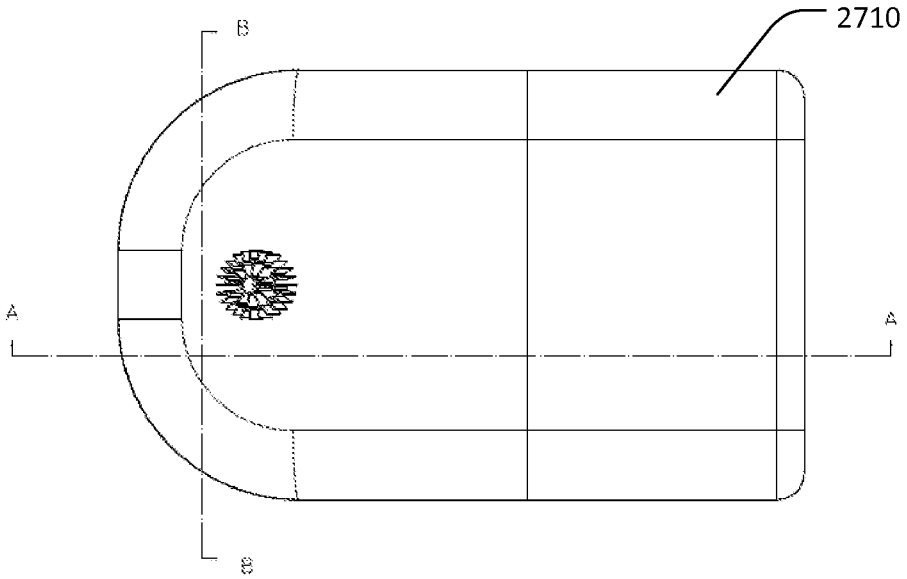
FIG. 7B is a top view of the third embodiment view of the present invention in FIG. 7A.

FIG. 7A is a perspective view of a third embodiment of the present invention illustrated as a Luminaire 2700. FIG. 7B is a top view of the Luminaire 2700. FIG. 7C is a cut-away side view of the Luminaire 2700 cut along line A-A illustrated in FIG. 7B. FIG. 7D is a perspective view of internal portions of the Luminaire 2700 with some parts of external portions removed for illustration.

Referring to FIGS. 7A through 7D, the Luminaire 2700 includes a luminaire housing 2710 (also referred to as the luminaire body 2710) enclosing portions of the lighting device 2900 illustrated in FIGS. 5A through 6D and discussed above. The housing 2710 provides an Edison electrical socket 2902 where the SELB 2800 is plugged in to obtain power.

In the existing art, the luminaire housing 2710 is often painted with polyester or epoxy paint which has a very poor thermal conductivity. Accordingly, heat dissipation capacity of the housing 2710 is less than often desired. In the present invention, the external heat sink 2913 (external to the housing 2710), thermally connected to the SELB 2800 (enclosed within the housing 2710), provides for increased heat dissipation capacity for the Luminaire 2700.

Referring to FIGS. 5A through 7D but mostly to FIGS. 7A through 7D, in the illustrated sample embodiment, the housing 2710 encloses the SELB 2800, the heat pipe 2910, and the thermal adaptor 2911. The external heat sink 2913 is outside of the housing 2710. The heat bolt 2912 is placed through an opening (hole) defined by the housing 2710; the heat bolt 2912 mechanically and thermally connecting the thermal adaptor 2911 with the external heat sink 2913. In this configuration, heat generated by the SELB 2800 is transferred outside the housing 2700 through the heat pipe 2910, the heat adaptor 2911, and the heat bolt 2912.

The bolt 2912 may be straight or bent in any shape to pass through the housing 2710 of the luminaire 2700. Alternatively, the bolt 2912 may be a taper bolt which fits with a corresponding taper hole in the housing 2710 of the luminaire 2700. Thermal grease on various contact points between the SELB 2800, the heat pipe 2910, the heat adaptor 2911, the heat bolt 2912, and the external heat sink 2913, increases heat transfer efficiency between these components. The connection of the bolt 2912 and the heat-sink 2913 may also be achieved by means of screw threads, a press or a taper fit to minimize thermal resistance at the interface.

Fourth Embodiment of the Present Invention

FIG. 8A is a perspective view of a fourth embodiment of the present invention illustrated as the SELB 2800 with heat foils 2829A and 2829B (generically or collectively, "heat foil 2829"). FIG. 8B is a partially exploded perspective view of the embodiment of the present invention illustrated in FIG. 8A. FIG. 8C is a top view of the embodiment of the present invention illustrated in FIG. 8A. FIG. 8D is a side view of the embodiment of the present invention illustrated in FIG. 8A.

Referring to FIGS. 8A through 8D generally and also to FIG. 2E, the SELB 2800 is the device illustrated in FIGS. 1A through 4B and discussed herein above. The heat foil 2829 is a thermal dissipation device mechanically and thermally coupled to the Body 2820 of the SELB 2800. In the illustrated sample embodiment, the heat foil 2829A has an edge which is mechanically and thermally coupled to a side groove of Body 2820. The heat foil 2829A may be coupled to the Body 2820 by means of a thermal adhesive. In the illustrated embodiment, a fastening element such as a retaining bar 2830A may also be used to fasten the heat foil 2829A against the Body 2820. Likewise, the heat foil 2829B may be coupled to the Body 2820 in a number of ways.

Heat Foil 2829

The heat foil 2829 may be made of thin sheet metal such as Copper or Aluminum, or alloys of thermal conductive materials. The thickness of the heat foils 2829 may range from tens of micrometers to several hundreds of micrometers. The heat foils 2829 may be formed or shaped to fit with minimal thermal resistance to the Body 2820. When the SELB 2800 is installed inside an enclosure, the heat foils 2829 may extend beyond the enclosure such that heat can flow from the SELB 2800 to outside the enclosure and be dissipated. Another advantage of the heat foil 2829 is that it may also function as an optical reflector if it is made of reflective sheet material.

Fifth Embodiment of the Present Invention

FIG. 9A is a perspective view of a fifth embodiment of the present invention illustrated as a Luminaire 2990. FIG. 9B is a top view of the Luminaire 2990. FIG. 7C is a cut-away side view of the Luminaire 2990 cut along line C-C illustrated in FIG. 9B. FIG. 9D is a perspective view of internal portions of the Luminaire 2990 cut along line D-D illustrated in FIG. 9B.

Referring to FIGS. 9A through 9D, the Luminaire 2990 includes a luminaire housing 2992 enclosing portions of the lighting device 2890 illustrated in FIGS. 8A through 8D and discussed above. The housing 2992 defines openings through which the heat foils 2829 extend outside the housing 2992 allowing the heat generated within the housing (by the SELB 2800) to dissipate outside the housing 2992.

CONCLUSIONS

The present invention as disclosed in various sample embodiments illustrated in the Drawings and discussed herein may be used in general lighting applications such as, for example only and without limitations, light bulbs, lighting luminaires, street lights, highway lights, parking lights, industrial lighting, and many others. The present invention as disclosed in various sample embodiments illustrated in the Drawings and discussed herein may be used to replay light sources such as incandescent, fluorescent, HPS, LPS, halogen light bulbs or modules.

The present invention as disclosed in various sample embodiments illustrated in the Drawings and discussed herein include at least three thermal solutions—first, the device's own body has heat fins with large surface areas for heat dissipation by convection; second, a heat transport device extracts heat from the body and transports the heat to an external heat sink; and third, a flexible heat foil that may be coupled to the body to increase heat dissipation surface as well as to extend the heat dissipation surface beyond any enclosures.

From the foregoing, it will be appreciated that the present invention is novel and offers advantages over the existing art. Although a specific embodiment of the present invention is described and illustrated above, the present invention is not to be limited to the specific forms or arrangements of parts so described and illustrated. For example, differing configurations, sizes, or materials may be used to practice the present invention.

I claim:

1. A lighting device comprising a body defining a side opening and having an external surface;

a platform within said body;

at least one LED module mounted on said platform, said LED module operable to emit light and generating heat when operating;

wherein said body including heat fins on its external surface, the heat fins increasing the surface area of the body for increased heat dissipation;

a sleeve coupled to said body;

a screw adaptor defining a groove track, said screw adaptor rotatably engaged to said sleeve, said screw adaptor including Edison screw threads;

a dowel pin engaged to said sleeve and riding the groove track; and a set screw engaged to said sleeve providing a locking mechanism.

2. The lighting device recited in claim 1 further comprising a lens covering the side opening.

3. The lighting device recited in claim 1 further comprising a reflector proximal to the side opening wherein said reflector reflects light from said LED module in a desired direction.

4. The lighting device recited in claim 1 wherein said body having a tubular shape and having a first and a second end, the lighting device further comprising a thermal end cap covering the first end of said body.

5. The lighting device recited in claim 1 further comprising at least one heat foil connected to said body, said heat foil providing additional heat dissipation surface; said heat foil having an edge, the edge being coupled to the external surface of said body; and portions of said heat foil extending away from said body.

6. The lighting device recited in claim 1 wherein said heat fins of said body form a groove and wherein said heat foil coupled to said body along the groove.

7. The lighting device recited in claim 1 wherein said heat fins of said body form a groove and further comprising a retaining bar inserted along the groove securing said heat foil to said body.

8. The lighting device recited in claim 1 wherein said body having a tubular shape having a first end and a second end and further comprising:

an end cap covering the first end; and an Edison screw cap covering the second end.

9. The lighting device recited in claim 1 further comprising at least one circuit board providing structure for mounting electrical components to operate on input electrical power for said LED modules.

10. A lighting device recited in claim 1 further comprising:

an external heat sink, a heat pipe connected to said body;

a heat adaptor connected to said heat pipe; and a heat bolt connected to said heat adaptor and said external heat sink.

11. The lighting device recited in claim 10 wherein said heat pipe including channels of fluids.

12. A lighting device comprising a light bulb;

a housing enclosing said light bulb;

an external heat sink thermally connected to said light bulb; and a heat pipe connecting said light bulb with said external heat sink;

wherein said light bulb comprising:

a body;

a sleeve coupled to said body;

a screw adaptor defining a groove track, said screw adaptor rotatably engaged to said sleeve, said screw adaptor including Edison screw threads;

a dowel pin engaged to said sleeve and riding the groove track;

a set screw engaged to said sleeve providing a locking mechanism; and wherein said housing defining an Edison socket adapted to engage said Edison screw threads.

13. A lighting device recited in claim 12 further comprising:

at least one heat foil couple to said light bulb wherein said heat foil extends beyond the housing allowing heat from said light bulb to dissipate outside the housing.

14. The lighting device recited in claim 13 wherein said light bulb including a body having heat fins, said heat fins forming grooves where said heat foil couples with said light bulb.

* * * * *